United States Patent [19]

Riley et al.

[11] 4,278,725

[45] Jul. 14, 1981

[54] CERMET RESISTOR AND METHOD OF MAKING SAME

[75] Inventors: Richard E. Riley, Riverside; Bradley D. Turner, Pomona, both of Calif.

[73] Assignee: Spectrol Electronics Corp., City of Industry, Calif.

[21] Appl. No.: 114,010

[22] Filed: Jan. 21, 1980

[51] Int. Cl.[3] ..... H01B 1/02

[52] U.S. Cl. ..... 428/208; 29/610 R; 29/620; 252/500; 252/514; 252/518; 338/308; 427/102; 428/323; 428/434

[58] Field of Search ..... 252/500, 514, 518; 29/610 R, 620; 338/308; 428/208, 323, 434; 427/101, 102

[56] References Cited

U.S. PATENT DOCUMENTS

| | | | |
|---|---|---|---|
| 2,950,995 | 8/1960 | Place | 428/432 |
| 2,950,996 | 8/1960 | Place et al. | 428/433 |
| 3,252,831 | 5/1966 | Ragan | 428/427 |
| 3,326,720 | 6/1967 | Brahl et al. | 428/434 |
| 3,342,568 | 9/1967 | Capillon | 428/434 |
| 3,573,229 | 3/1971 | Herbst et al. | 252/514 |
| 3,609,105 | 9/1971 | Cole | 252/514 |
| 3,619,287 | 11/1971 | Stankavich | 427/102 |
| 3,639,274 | 2/1972 | Brandt et al. | 252/514 |

*Primary Examiner*—James J. Bell

*Attorney, Agent, or Firm*—J. Raymond Curtin; Donald F. Daley

[57] ABSTRACT

A cermet resistor element utilizing a silver-gold alloy to improve the contact resistance variations and the method of making the element are disclosed. A gold resinate and a silver resinate are mixed with the noble metal resinates and glass frit to make a cermet material. The mixture is heated to drive off the organic resinate materials and to alloy the silver and gold. The resultant material is ground to a powder, reheated and reground. The powder is mixed with a volatile material to form a paste which can be applied to a substrate to form the resistance element. The element is heated to drive off the volatile material and fuse the glass into a solid mass. The silver and gold form a silver-gold alloy during the process and settle on the top surface of the element in globules and improve the contact resistance variations of the element.

4 Claims, No Drawings

CERMET RESISTOR AND METHOD OF MAKING SAME

FIELD OF THE INVENTION

This invention relates generally to thick film electrical resistors of the cermet type and in particular to a cermet resistor with an improved contact resistance variation, and the method of producing such resistors.

BACKGROUND OF THE INVENTION

Cermet resistor elements and their method of manufacture are well known. These resistor elements consist of an electrically non-conducting base with a glass material containing conducting or semi-conducting materials, coated thereon. Such elements can be used for various electrical resistors including variable resistors and potentiometers. Electrical leads are connected to each end of the cermet resistor element in electrical contact therewith. In variable resistor and potentiometer applications, a wiper contact is moved in contact with the surface of the resistor. The degree of conductivity between the contact and the surface of the cermet determines the contact resistance variation (CRV) and the electrical noise of the variable resistor or potentiometer. To improve the CRV and to decrease the electrical noise, small quantities of highly conducting metal such as gold have been used in the composition of the resistance material. The gold ultimately deposits in minute particles on the top surface of the cermet, improving the conductivity between the contact and the cermet material. Silver, which is also highly conductive, has not been generally used for this purpose due to the tendency of silver ions to migrate in the presence of a direct current field.

The use of gold to improve the CRV in cermet resistors is very costly due to the continuing increase in cost of gold, and although silver has also increased in price, it is considerably less expensive than gold. The present invention contemplates the use of a silver-gold alloy which reduces the cost of the materials used while maintaining the low CRV and low electrical noise characteristics of gold and reduces the migration characteristics of the silver. Based on test results with and without the silver-gold alloy in the resistance material, the alloy apparently does not significantly affect the bulk resistivity of the resistance element. Spectroscopic analysis and electron microscope studies indicate that the gold-silver alloy particles reside on the surface of the cermet material while a small number of particles of the alloy are dispersed throughout the cermet material. The particles dispersed in the material are, apparently, not of a size and quantity to alter the resistivity beyond the normal variations encountered with this type of material.

SUMMARY OF THE INVENTION

Therefore, it is an object of the present invention to provide a cermet resistance material having finely divided particles of a silver-gold alloy on the surface thereof. It is also an object of the invention to improve the CRV of cermet resistors and to reduce the cost of cermet resistors having good CRV.

It is also an object of the invention to reduce the quantity of gold required in the manufacture of cermet resistors having improved CRV. It is a further object of the invention to provide a method of manufacturing of cermet resistors having finely divided particles of silver-gold alloy fairly uniformly dispersed on the surface thereof. It is also an object of this invention to provide a method of manufacture of cermet resistors utilizing silver to improve the contact resistance variation and to reduce migration characteristics of the silver.

These and other objects of this invention are attained by mixing gold and silver resinates in the range of 1 to 99% silver to 99 to 1% gold to the original mixture of glass and noble metals making up the resistance material. The preferred range of silver to gold is 90 to 10% silver to 10 to 90% gold.

DESCRIPTION OF THE PREFERRED EMBODIMENT

Normally in the manufacture of cermet materials for use in the production of electrical resistance elements, a glass powder is mixed with resinates of noble metals such as rhodium, ruthenium, iridium, or other noble metals or some combination thereof. The composition is mixed to produce a heterogenous mixture which is heated to a temperature sufficient to drive off the decomposable resinates. The remaining metal coats the glass powder, and the resultant material is ground to a powder, reheated and again ground to a powder. The powder is mixed with a volatile carrier compound of ethyl cellulose, a wetting agent and decyl alcohol or butyl carbitol acetate, or pine oil, and applied to the surface of an insulating base in the configuration desired in the final resistance element. The resistance element is then heated to a temperature and for a time sufficient to drive off the volatile component and to melt the glass. Upon cooling, the glass solidifies with the noble metal particles fairly uniformly dispersed throughout.

The present invention contemplates the addition of silver and gold resinates to the original mixture of glass powder and noble metal resinates. Upon subsequent heatings of the glass powder, the gold and silver form a silver-gold alloy. The mixture is then ground to a powder and mixed with a volatile component and applied to the surface of an insulating base. The mixture is then heated to a temperature in excess of the melting temperature of the glass, and the silver-gold alloy tends to rise to the surface in minute globular form. Upon cooling and solidifying, the cermet material has a surface having fairly uniformly dispersed minute particles of alloy embedded therein.

Examples of processes, materials and elements used in the manufacture of cermet resistors can be found in U.S. Pat. No. RE 27,603 entitled Process of Producing an Electrical Resistor, issued in the name of Anthony J. Stankavich, on Nov. 9, 1971, and in U.S. Pat. Nos. 2,950,996 entitled Electrical Resistance Material and Method of Making same, and 2,950,995 entitled Electrical Resistance Element, both issued in the name of T. M. Place, Sr., et al, on Aug. 30, 1960. The Place patents 2,950,995 and 2,950,996 teach the use of alloys of gold with rhodium, and gold with platinum and rhodium or with palladium and rhodium, to control ohmic resistance value of the resistance material. It is also suggested that silver be used to control the temperature coefficients of resistivity. These characteristics apparently are dependent upon the gold alloys and the silver being dispersed through the cermet material. The present invention alloys the gold with the silver, with the alloy forming in globules on the top of the resistance element. U.S. Pat. No. 3,252,831 entitled Electrical Resistor and Method of Producing the Same, issued to R. C. Ragan on May 24, 1966, teaches the use of ternary systems of silver, platinum and gold in the manufacture of cermet resistance elements, however, this patent indicates that silver and gold systems without platinum or some other element are unsuitable.

The temperature used in the firing of the resistance elements is usually above the melting point of the glass but below the melting point of the gold or silver. Therefore, the gold-silver alloy exists in the molten material as discrete particles which, depending on the viscosity of the liquid material, float to the surface. For low ohmic value resistors the percentage of noble metal is high and the percentage of glass is low. For high ohmic value resistors the percentage of noble metal is low and the percentage of glass is high. Elements have been made with the glass content as low as approximately 30% and in each case the gold silver alloy settles on the top surface of the element in fairly uniformly dispersed, generally spherical globules.

The preferred method for producing the resistance element according to this invention is to first mix predetermined quantities of a powdered lead borosilicate glass with a precious metal resinate solution made up of a combination of ruthenium, rhodium, iridium, and other metals. The glass desirably is of the high melting point type, becoming molten at about 800° C., and is ball milled with methanol or other carrier for sufficient time period to pass a 325 mesh sieve. The glass-metal resinate mixture, after blending, is heated to about 350° C. for approximately 45 minutes and after cooling is ground or crushed until the majority of the resultant particles are less than one-sixteenth of an inch in diameter. The particles are heated or sintered for about 3 hours at approximately 600° C.

In a series of examples of the present inventions, a number of compositions were tested using various ratios of gold and silver. The following chart indicates the percentage of gold and silver used in the composition and the CRV measured in the resulting element.

TABLE I

| CONSTITUENT | | A | B | C | D | E | F | G | H |
|---|---|---|---|---|---|---|---|---|---|
| Silver | gm | | 2.98 | | 3.54 | 3.96 | 0.04 | 3.60 | 0.40 |
| Gold | gm | | 0.950 | | 1.18 | 0.04 | 3.96 | 0.40 | 3.60 |
| Ruthenium | gm | 1.26 | 1.26 | 0.694 | 0.694 | 1.84 | 1.84 | 1.84 | 1.84 |
| Rhodium | gm | | | 0.120 | 0.120 | 0.463 | 0.463 | 0.463 | 0.463 |
| Niodium | gm | | | 0.247 | 0.247 | 0.112 | 0.112 | 0.112 | 0.112 |
| Bismuth | gm | | | 0.130 | 0.130 | 0.508 | 0.508 | 0.508 | 0.508 |
| Molybdenum | gm | | | 0.269 | 0.269 | 0.117 | 0.117 | 0.117 | 0.117 |
| Copper | gm | | | 0.609 | 0.609 | | | | |
| Iridium | gm | | | 0.742 | 0.742 | | | | |
| Glass | gm | 20.00 | 20.00 | 50.47 | 50.47 | 29.23 | 29.23 | 29.23 | 29.23 |
| Resistance in Ohms per sq. | | 3.8K | .873K | 17.5K | 20.0K | 1.48K | .492K | 1.77K | .405K |
| Average CRV (%) | | 1.5 | 0.20 | 0.80 | 0.15 | 1.0 | 0.10 | 0.20 | 0.10 |

In each example the weight of metal and glass used, in grams, is indicated. Each composition was mixed, heated to 350° C. for 45 minutes, allowed to cool, ground to a powder, and reheated to approximately 500° C. for 16 hours. The material was then reground to a powder and mixed with a volatile material, applied to an insulating material, fired to 950° C. for 45 minutes and allowed to cool. The resultant film after firing was between 0.0004 and 0.0013 inches thick. The Contact Resistance Variation (CRV) was measured as indicated in the chart. The CRV is the variation in resistance measured across the surface of the element expressed as a percentage of the resistance of the element.

As can be seen from the chart the CRV for compositions A and C, which did not contain the silver-gold alloy, is relatively high. CRV values should be less than approximately 0.5% and desirably less than 0.3%. Composition B was tested to show the value of the alloy in a simple ruthenium system. When compared to composition A the alloy in composition B improved the CRV from 1.5% to 0.2%.

A comparison of a more complex system involving additional prior art components with the ruthenium shows a CRV at 0.8%, (composition C) and 0.15% for the same materials with the addition of a 75% silver, 25% gold alloy, (composition D).

Compositions G and H contain 90% silver to 10% gold and 10% silver to 90% gold, respectively and show that both compositions have a CRV well within the desired range. Compositions E and F demonstrate alloys of 99% silver and 1% gold and 1% silver and 99% gold are usable although the CRV for the low gold alloy is above the typical 0.5% for elements of this type. It appears that any combination of silver and gold in alloy form is usable with approximately 90% silver to 10% gold being the preferred range.

It should be noted that the addition of silver to the composition appears to produce an increase in the total resistance of the element. The prior art substantiates this condition as noted in U.S. Pat. No. 3,573,229 issued Mar. 30, 1971 in the name of D. L. Herbst, et al. The change in resistance however appears to be within the resistance variations expected in the production of this type of material. Since the resistance, in Ohms per square, will vary between batches of material prepared from the same constituents and will vary dramatically depending on the thickness of the film tested, the variations in the resistance encountered by the addition of silver to material do not appear to have an appreciable effect on the anticipated resistance of the element. The observation that the resistance increases with the addition of silver is surprising but not totaly unexpected based on the teachings of the above-mentioned Herbst patent.

It is to be understood that the invention has been described in terms of a preferred embodiment and that variations in the materials, composition, conditions and method steps may be made by those skilled in the art within the scope and spirit of the invention as defined in the appended claims.

We claim:

1. A resistance element comprising an electrically nonconductive base having a layer of resistance material thereon, said resistance material comprised of a glass having a noble metal in finely divided form dispersed throughout the glass and minute particles of a gold-silver alloy on the surface of the glass.

2. A resistance element comprising an electrically nonconductive base having a layer of resistance material thereon said resistance material comprised of a cermet material having particles of gold-silver alloy containing between approximately 90% silver and 10% gold to 10% silver and 90% gold on the surface thereof.

3. The resistance element of claim 2 wherein the gold-silver alloy is composed of between 1% to 99% gold and 99% to 1% silver.

4. A method of producing a film type material having generally spherical globular particles of a gold-silver alloy embedded in the surface comprising the steps of:

mixing a gold resinate and a silver resinate in the preparation of the desired alloy to a mixture of glass powder and noble metal resinates, heating the mixture to drive off the organic materials in the resinates and to allow the gold and silver to form an alloy, cooling the resultant material, grinding the resultant material to powder, mixing the powder with a volatile compound to form a paste and applying the paste to an electrically nonconductive surface in the configuration desired, heating the paste to a temperature sufficient to drive off the volatile compound and melt the glass, holding the material in the moltant state for a time sufficient to allow the gold-silver alloy to rise to the surface, and cooling the material to solidify the glass with the gold-silver alloy embedded in the surface.

* * * * *